United States Patent [19]

Reuther

[11] 3,990,697

[45] Nov. 9, 1976

[54] BALANCE BEAM WITH A RESILIENT COATING

[75] Inventor: Richard Reuther, Oppau, Germany

[73] Assignee: Olympic Spieth Anderson Limited, Orillia, Canada

[22] Filed: Feb. 18, 1975

[21] Appl. No.: 550,622

[52] U.S. Cl. ..... 272/111

[51] Int. Cl.[2] ..... A63B 1/00

[58] Field of Search ..... 272/57 R, 60 R, 61, 272/62, 63, 64, 66, 111; 9/310 E; 280/87.04 A

[56] References Cited

UNITED STATES PATENTS 3,178,333 4/1965 Gabrielsen ..... 272/66 X 3,242,509 3/1966 Nissen ..... 272/60 R

FOREIGN PATENTS OR APPLICATIONS 1,549,312 1968 France ..... 272/60 R

OTHER PUBLICATIONS

Martial Arts Supplies Co. Ad in Mar. 1973 Issue of Black Belt, p. 55.

*Primary Examiner*—Anton O. Oechsle

[57] ABSTRACT

Gymnastic apparatus comprising a balance beam having a resilient coating or padding thereon which is itself covered with a layer of material which, although having some resilience, is more stable than the resilient coating or padding.

7 Claims, 2 Drawing Figures

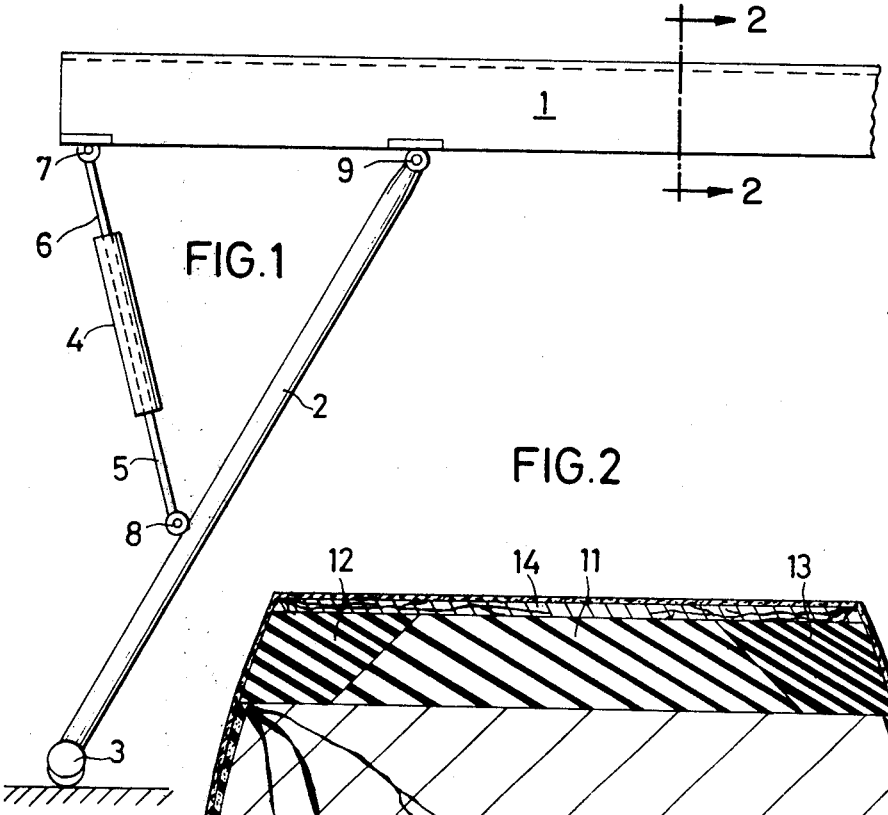
FIG.1
FIG.2
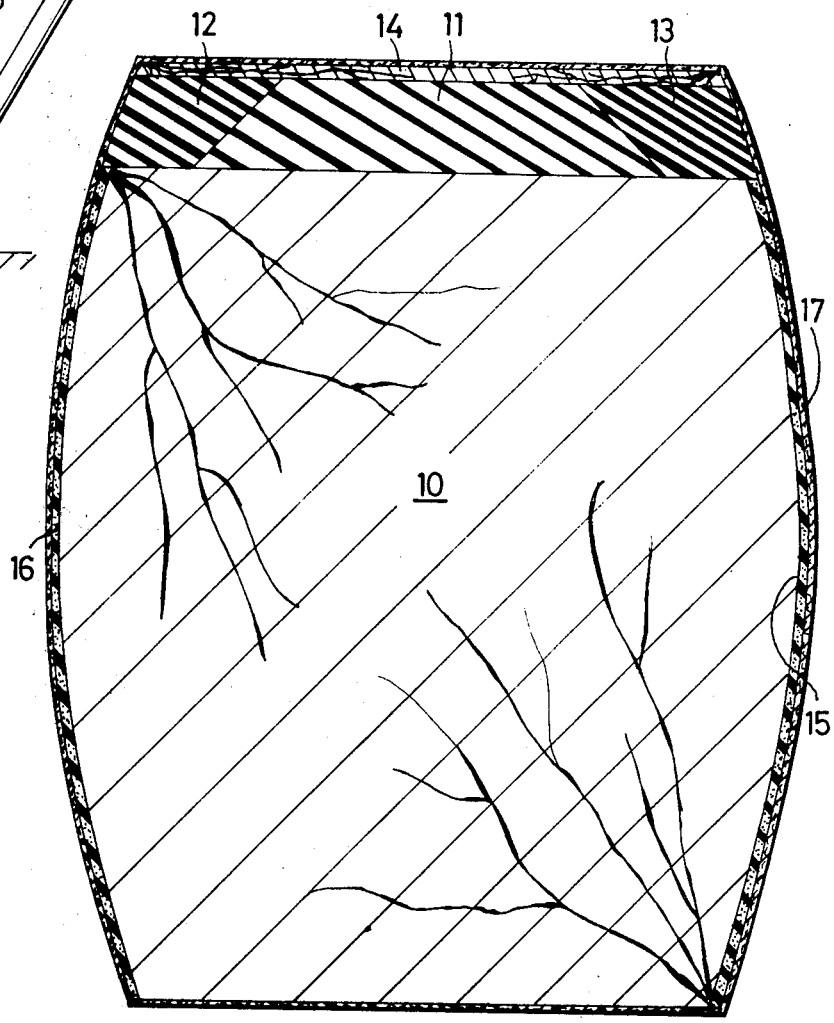

BALANCE BEAM WITH A RESILIENT COATING

BACKGROUND OF THE INVENTION

In U.S. Pat. No. 3,510,129 a horizontal balance beam is disclosed having a supporting leg assembly which is so arranged to leave the area below the beam clear. The beam is made of solid wood and it has been found that falls thereon often have serious consequences. Physicians have warned, in fact, that even simple exercises, such as rolls on the bare wooden beam may be enough to damage the spinal column permanently. Later designs have provided the beam with resilient coatings of a non-slip material, whereby incidents of accidents and injury have been reduced.

Unfortunately, experience has now shown that the stability of an athlete on the beam is adversely affected by the flexibility of a resilient coating thereon. Since it has been found that the resilient coating is necessary in the interests of safety, it would be desirable to retain the safety feature while at the same time providing increased stability in the resiliently coated beam.

SUMMARY OF THE INVENTION

The present invention comprises, essentially, a gymnastic apparatus having an elongated horizontal balance beam with supporting structure attached thereto supporting the beam above the floor. The beam has a resilient coating attached to its top surface and a resilient covering is located over and attached to the coating. The covering is made of a material which is more stable than that of the resilient coating.

BRIEF DESCRIPTION OF THE DRAWINGS

FIG. 1 is side view in elevation of one end of a balance beam embodying the present invention; and FIG. 2 is a sectional view taken through line 2-2 of the actual beam shown in FIG. 1.

DESCRIPTION OF THE PREFERRED EMBODIMENT

Referring in particular to FIG. 1 of the drawings, the balance beam 1 has a supporting structure similar to that shown in the afore-mentioned U.S. Pat. No. 3,510,129, although other supporting structures can be utilized since it is the resilient coating provided for the actual horizontal beam member which is the essence of the invention. The supporting stucture of FIG. 1 comprises a pair of split legs 2 (the split leg at the other end of the beam being, of course, not shown), leg pads 3 and a height adjusting mechanism comprising an adjusting sleeve mechanism 4, telescoping adjusting rods 5, 6 and pivotal connectors 7, 8. The adjusting mechanism in conjunction with pivotal attachment 9 for the legs 2 allows for the raising and lowering of the beam 1.

Referring now to FIG. 2 of the drawings, a transverse cross section of the actual beam member illustrated in FIG. 1 is shown having wooden core or solid bar member 10. Affixed to the top surface of the beam is a coating 11 of one or more layers of resilient material, such as rubber or a rubber-like material, which is in turn topped with a covering 14, attached to and over the coating 11, which, although having resilient properties also, is of a more stable or rigid material, preferably wood or plastic. The rigidity of the covering 14 is such that it can sag and yet any forces acting thereupon are distributed over a wider area.

In order to prevent the edges of the supporting surface of the beam, i.e. covering 14, from being more flexible than and sagging more than the central portion thereof, which action would have a deleterious effect on the athlete's stability, advantageously those portions of the coating which overlie the edges of the beam, i.e. edges 12, 13 of the resilient coating 11 under the more stable covering 14, are made of a material having a greater degree of hardness than those portions of the coating which are disposed inwardly of the edges of the beam, such as a harder rubber. It is a relatively simple matter to match the different degrees of resiliency in the covering 14 and the edges 12, 13 so that the same degree of flexibility exists over the entire width of the supporting surface.

Advantageously, the lateral surfaces of the beam are provided with a thin layer 15 of resilient material and the whole beam is provided with an outer wrapping 17 of suitable material such as carpeting or plastic, such as vinyl, in order to improve the grip. The wrapping may itself be rubber backed to improve grip. It is desirable to join the various layers making up the composite beam by applications of adhesive 16.

The considerable advantages enjoyed by the balance beam of the invention are that the bar is provided with a uniformly flexible surface; there is no adverse effect on the stability of the athlete on the bar and, in the event of a fall, the entire surface, including the edges, is sufficiently flexible to prevent serious injury. Experience with the bar of the present invention has shown that, even with frequently repeated simple exercises practised thereon, the surface resiliency is sufficient to prevent injury to the spinal column. Moreover, use of a wrapping on the beam in combination with the underlying resilient layer, substantially improves the grip during gymnastic exercises, thus resulting in even greater safety.

What I claim as my invention is:

1. In gymnastics apparatus having an elongated horizontal balance beam and supporting structure attached thereto supporting the beam above the floor, the improvement in combination therewith comprising a resilient coating on top of the beam, those portions of the coating which overlie the edges of the beam having a greater degree of hardness than those portions which are disposed inwardly of the edges of the beam, and a resilient covering attached to and over the resilient coating, said covering being a material having greater rigidity than that of the coating, the rigidity of the covering being such that any forces acting thereupon are distributed over a wide area on the beam.

2. The combination of claim 1 wherein the beam has an outer wrapping chosen from plastic and carpeting covering the whole beam and disposed outwardly of the covering.

3. The combination of claim 2 wherein the material of the coating is chosen from rubber and a rubber-like composition.

4. The combination of claim 3 wherein the material of the covering is chosen from wood and plastic.

5. The combination of claim 2 wherein the side surfaces of the beam are also coated with a layer of resilient material.

6. The combination of claim 5 wherein the beam has an outer wrapping chosen from plastic and carpeting covering the whole beam and disposed outwardly of the covering.

7. The combination of claim 6 wherein the beam, coating, covering and wrapping are joined together by layers of adhesive.

* * * * *